US006302608B1

(12) United States Patent
Holmes et al.

(10) Patent No.: US 6,302,608 B1
(45) Date of Patent: Oct. 16, 2001

(54) BOTTLE AND BRUSH COMBINATION

(75) Inventors: Richard A. Holmes; William H. Houghton, both of Akron; Paul G. Ouillette, Stow; John P. Cichello, II, Wooster, all of OH (US)

(73) Assignee: Joseph S. Kanfer, Richfield, OH (US)

( * ) Notice: Subject to any disclaimer, the term of this patent is extended or adjusted under 35 U.S.C. 154(b) by 0 days.

(21) Appl. No.: 09/766,075

(22) Filed: Jan. 19, 2001

Related U.S. Application Data

(60) Provisional application No. 60/176,742, filed on Jan. 19, 2000.

(51) Int. Cl.[7] ..... A46B 11/00

(52) U.S. Cl. ..... 401/125; 401/137; 401/123; 220/736; 215/390; 206/361

(58) Field of Search ..... 401/123, 125, 401/137, 139, 131, 118; 220/212, 735, 736; 215/228, 386, 390, 391, 383; 206/361, 362.2

(56) References Cited

U.S. PATENT DOCUMENTS

| | | | |
|---|---|---|---|
| D. 338,297 | 8/1993 | Singarella | D32/42 |
| D. 346,332 | 4/1994 | Kanfer et al. | D9/531 |
| D. 383,001 | 9/1997 | Bell et al. | D4/116 |
| 716,740 | 12/1902 | Muller et al. . | |
| 864,676 | 8/1907 | Nagely . | |
| 2,859,463 | 11/1958 | Hirsch . | |
| 3,354,492 | 11/1967 | Baumgartner . | |
| 3,754,831 | 8/1973 | Hutter | 401/139 |
| 3,843,991 | 10/1974 | Vallis | 15/167 R |
| 4,420,853 | 12/1983 | Gilman | 15/111 |
| 4,480,351 | 11/1984 | Koffler | 15/187 |
| 4,592,478 * | 6/1986 | Laconis . | |
| 4,618,443 | 10/1986 | Jude | 252/92 |
| 4,757,571 | 7/1988 | Young | 15/167.3 |
| 5,299,876 | 4/1994 | Singaarella | 401/139 |
| 5,312,197 | 5/1994 | Abramson | 401/6 |
| 5,355,545 | 10/1994 | Hoagland | 15/111 |
| 5,442,829 | 8/1995 | Summers | 15/106 |
| 5,558,453 | 9/1996 | Bell et al. | 401/137 |
| 6,036,389 | 3/2000 | Zima | 401/137 |

* cited by examiner

*Primary Examiner*—David J. Walczak
*Assistant Examiner*—Tuan Nguyen
(74) *Attorney, Agent, or Firm*—Reese Taylor

(57) ABSTRACT

A brush and bottle combination is disclosed in which the bottle has a blind recessed area formed in its peripheral surface and a shoulder projecting outwardly into the blind recessed area. This shoulder is formed integrally with the body of the bottle and has notches provided in its supporting legs. The brush has a main body portion and depending opposed legs which are integral with and depend from side edges of the body. These legs terminate in inwardly directed ribs which are engageable with the recesses in the legs of the shoulder member so that the brush can be snapped into place on the body within the recess, or substantially within the recess, so that the outer surface of the brush body and the peripheral surface of the container are substantially flush when the brush is connected thereto.

5 Claims, 3 Drawing Sheets

BOTTLE AND BRUSH COMBINATION

RELATED PATENT APPLICATIONS

This application claims the benefit of pending U.S. Provisional Patent Application No. 60/176,742, filed on Jan. 19, 2000.

FIELD OF THE INVENTION

This invention relates in general to liquid bottles and relates in particular to a combination of a bottle and an applicator or brush releasably attachable to the bottle.

BACKGROUND OF THE INVENTION

It has been known in the prior art that various liquid products can be packaged and marketed in containers. These containers take a multiplicity of shapes and sizes. The larger sizes in the prior art generally include an integral handle for ease of pouring and handling of the container and a neck at the top for receipt of a suitable cap to close off the container when not in use or when being shipped or stored.

Containers of this type are well known in the art and, as previously noted, are provided in a wide variety of sizes and shapes. They all have in common, however, a body and a handle and a neck which may or may not be threaded for receipt of a cap.

Similarly, it is known in the prior art, particularly in the prior art pertaining to cleaning products, such as soaps, lotions, etc., that brushes can be provided to be utilized in combination with various types of cleaning products to assist in removing dirt or grime in cooperation with the cleaning fluid, such as soap, etc. These brushes are sold and provided in a wide variety of shapes and sizes. Most of these brushes include structural features mounted on the surface of the body of the brush, such as bristles, to assist in the cleaning operation.

It is known that, particularly where containers contain soaps or other cleaning instruments, it is desirable to provide the brush along with the container of the cleaning material at the point of sale so that the purchaser acquires both the cleaning liquid and the brush to be used with it in one stop.

In view of that, brushes or other applicators have been marketed together with containers in the past. Generally, this is accomplished by shrinkwrapping the brush onto the exterior of the container with a well-known film. Other means of attachment have also been employed such as tape or a flexible attachment means such as a lanyard, string, tape, etc. The result, however, is a somewhat unsightly combination when the product is presented to the purchasing public.

Furthermore, the means of attaching the brush to the container are, by their nature, temporary in that once the shrinkwrap, for example, is removed, items become two separate items and it is relatively easy to misplace the brush so that when one returns to the container for another or subsequent cleaning operation, it becomes a problem to locate the brush to use in conjunction therewith.

Additionally, the means of attachment described above which are known in the industry are relatively expensive and require further fabrication or manufacturing costs.

Therefore, it is believed desirable to provide a combination bottle and applicator, making it probable that the brush will remain in close adjacency to the container throughout the use of the contents thereof and which does not add to manufacturing or packaging or fabrication or assembly costs, while retaining the advantage of having the brush readily accessible when one desires to use the contents of the container.

SUMMARY OF THE INVENTION

It is accordingly a principal object of this invention to provide a bottle and a brush combination wherein the bottle is readily and securely attached to the bottle, but yet readily removable therefrom without sacrifice of the packaging advantages of having the articles both presented to the purchaser as a combined unit and providing a secure place for storage of the brush when not in use.

It has been discovered that this object can be achieved by providing the typical container with a formed area in one wall of the bottle with this formed area being provided with a projecting shoulder which terminates in inwardly directed recesses. Such a bottle can be used in combination with a brush which has a main body and opposed depending legs with the legs terminating in inwardly turned shoulders so that the brush may be snapped into place in the cavity in the wall of the container.

These and other objects of the invention will become more apparent upon a reading of the following brief specification considered and interpreted in view of the accompanying drawings.

BRIEF DESCRIPTION OF THE PREFERRED EMBODIMENTS

Figure 1:
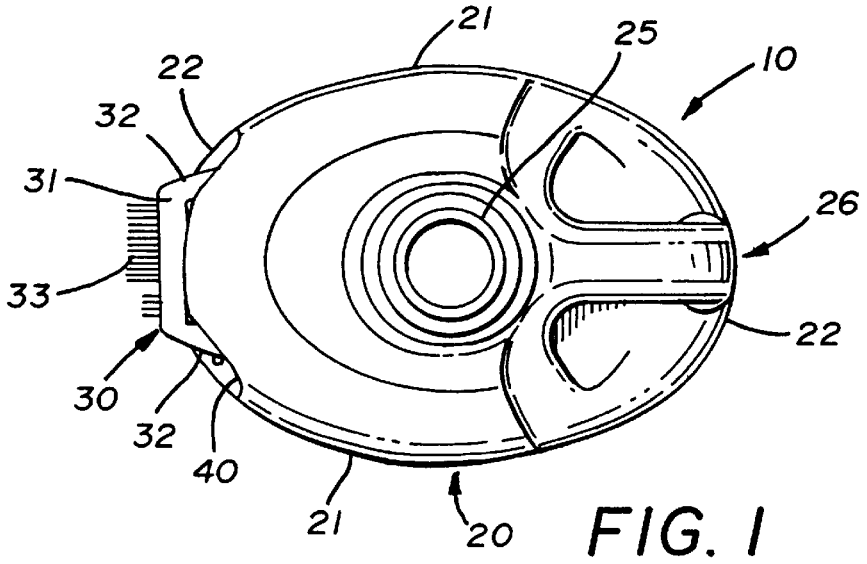
FIG. 1 is a top plan view of the improved brush and bottle combination of the present invention.
Figure 2:
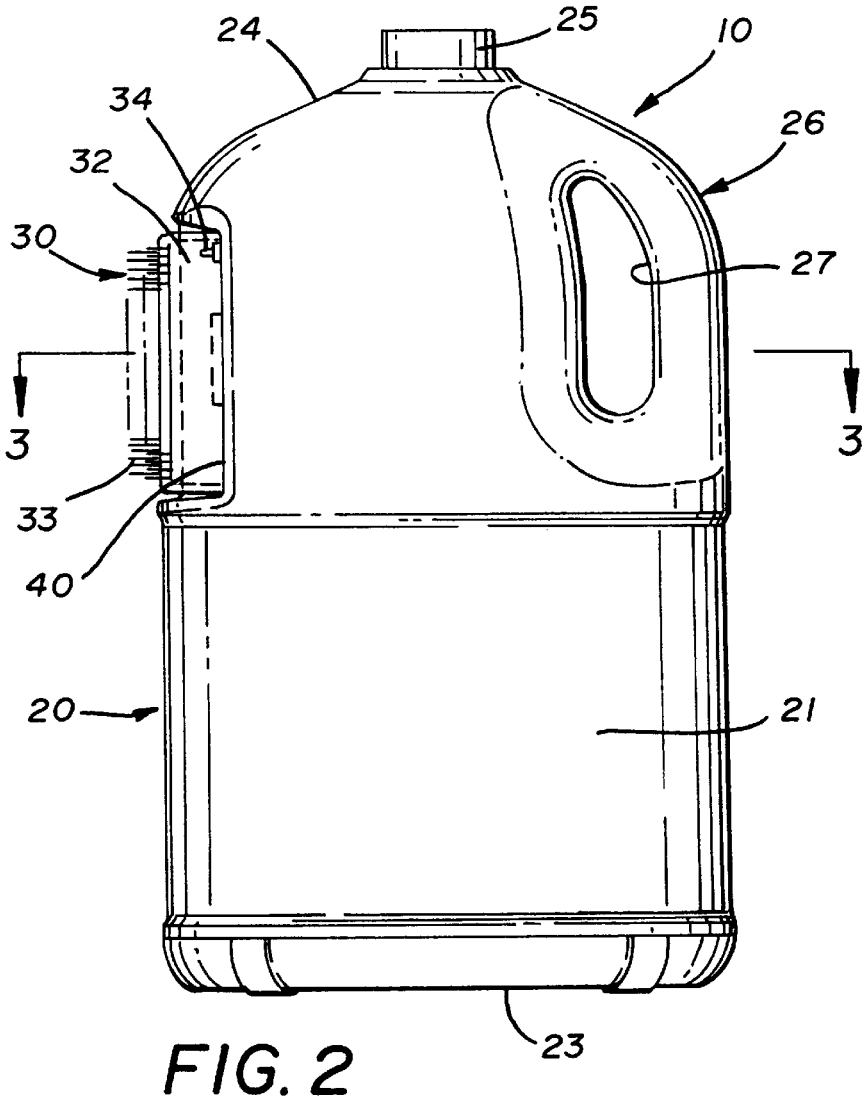
FIG. 2 is a side elevational view thereof.

It will be noted that the bottle and brush combination, which is the subject of this invention, is generally indicated by the numeral 10 in FIGS. 1 and 2. This combination includes the bottle 10 and the brush 30.

With regard to the bottle 10, it will be seen that it has opposed front and rear walls 21,21 and opposed end walls 22,22. These bottles are generally moded of plastic or some similar material and the front, rear and side walls are integral with each other so as to form a generally elliptical configuration as can be clearly seen in FIGS. 1 and 3 of the drawings in the form of the invention illustrated herein. It will be understood, of course, that a precise outline configuration, i.e., elliptical, is not to be construed as limiting to the invention and that other configurations could be employed.

Still referring to FIGS. 1 and 2 of the drawings, it will be seen that a carrying handle 26 is provided adjacent the top walls 24,24 which, as can be seen, taper toward the neck 25. The handle 26 is again molded into the body of the bottle 20 and has an opening 27 therin so that one can grasp the handle 26 with the fingers extending through the opening 27 to either carry the bottle 20 or to pour from it.

A bottom wall 23 is also provided so that the bottle can be rested on a horizontal surface when not in use. Finally, the neck 25 is shown in the drawings as having a plain outer surface, although it could be threaded for receipt of a cap (not shown) or a pump inasmuch as soaps or other liquids are commonly either poured or pumped from the bottle for use.

Figure 3:
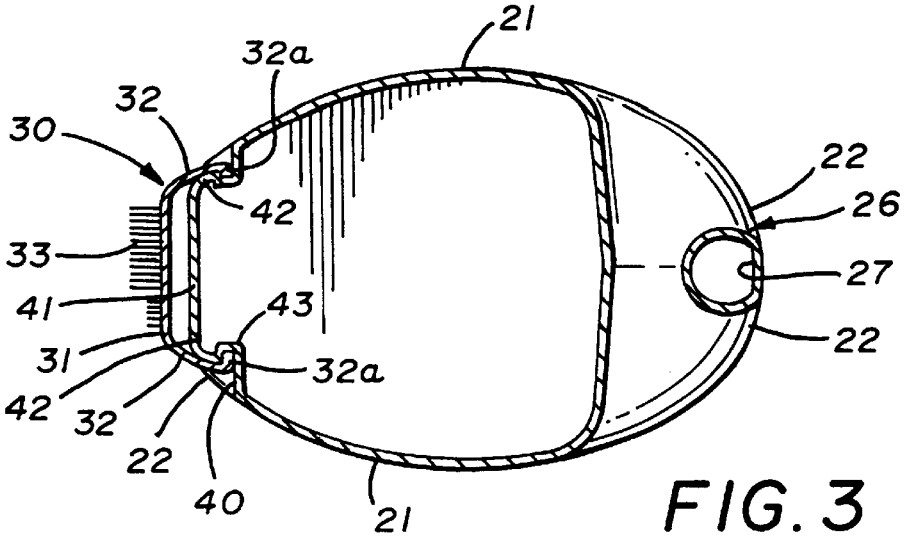
FIG. 3 is a sectional view taken along the line 3—3 of FIG. 1.
Figure 4:
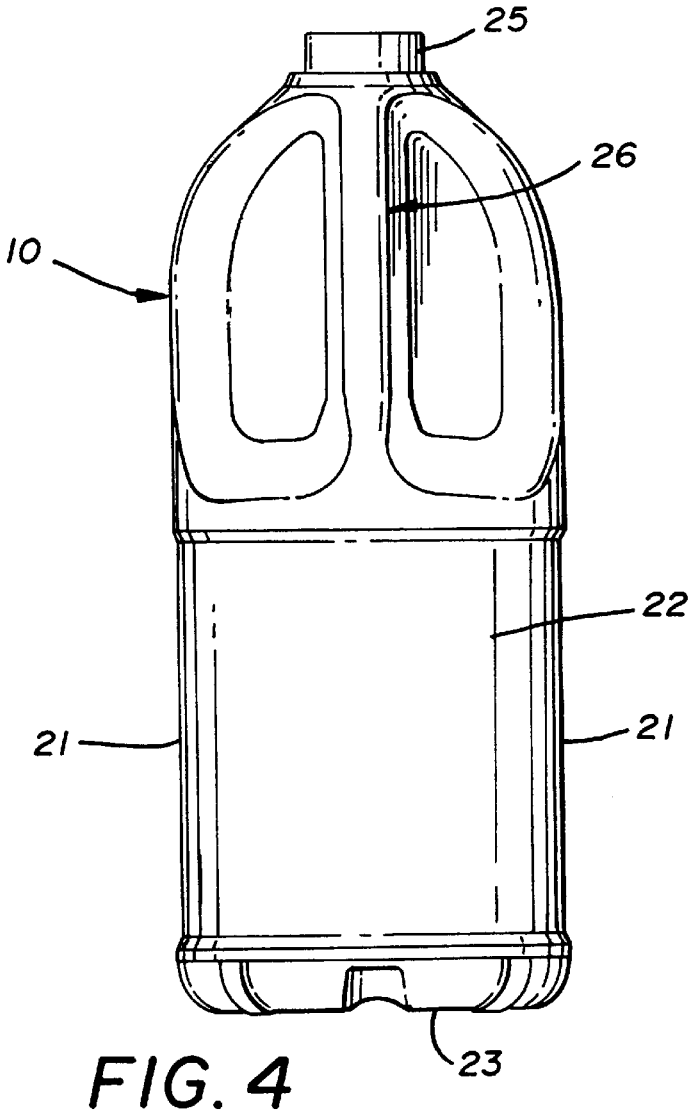
FIG. 4 is a side elevational view thereof taken from the right of FIG. 2.
Figure 5:
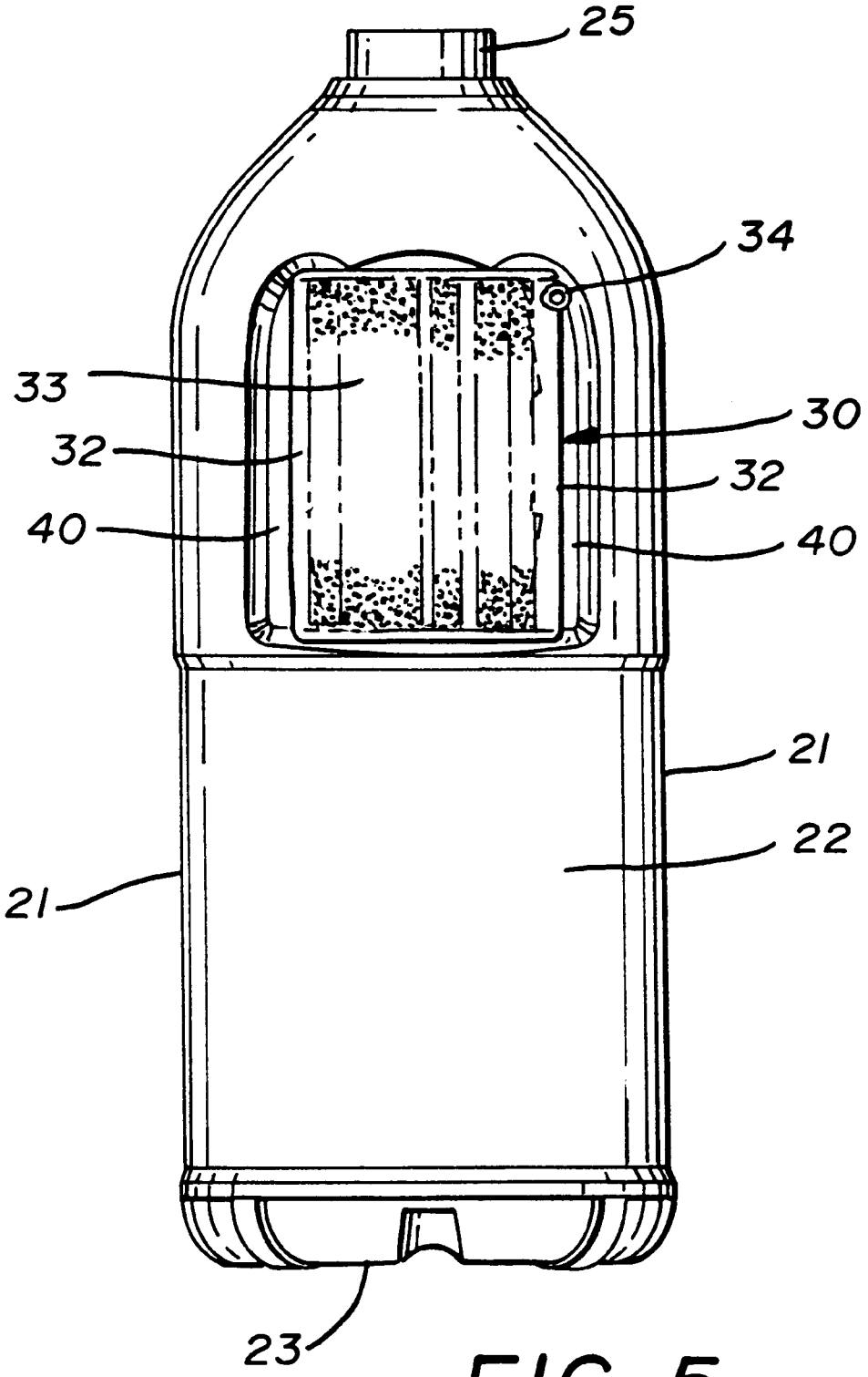
FIG. 5 is a side elevational view thereof taken from the left of FIG. 2.

Still referring to FIGS. 1 and 2 of the drawings and further referring to FIG. 3, it will be seen that one end wall 22 of the bottle has a recessed area 40 molded therein. This recessed area includes a pair of sidewalls 42,42 which extend outwardly from the innermost part of the recess 40 and terminate in a shoulder 41 which spans the distance between the walls 42,42. The walls 42 also have a counterbore or recessed area 43 extending inwardly toward each other for purposes which will be described.

Referring next then to FIGS. 1, 2, 3 and 5 of the drawings, it will be seen that the brush 30 has a main body portion 31 and depending legs 32,32 which depend from opposed side edges of the body 31. A plurality of bristles or other cleaning assistance members 33 project from one face of the body 31.

With particular reference to FIGS. 1 and 3 of the drawings, it will be seen that the legs 32,32 which depend from the main body 31 of the brush 30 terminate in inwardly turned lips 32*a*,32*a*. The material from which the brush is constructed is generally of a plastic-type material but, in any event, a material having some resiliency and flexibility so that, when it is desired to attach the brush to the bottle, as can be seen in FIGS. 1, 2, 3 and 5 of the drawings, it is simply necessary to push the legs 32,32 over the legs 42,42 of the bottle until the projections 32*a*,32*a* snap into the recesses 43 in the bottle. This permits the brush 30 to be relatively securely attached to the bottle and relatively easily attached thereto. It will be seen also that the legs 32,32 abut the outer portions of the legs 42,42 to further serve to locate and secure the brush 30 to the bottle 20.

While the attachment is relatively secure, it will be appreciated that, due to the nature of the material from which the brush 30 is fabricated, simply squeezing the same will enable one to easily remove it from the bottle 20.

In use, of course, generally the bottle and brush combination would be presented to the end user in the assembled condition shown in FIGS. 1, 2, 3 and 5 of the drawings with, of course, a cap or pump of some type in place on the neck 25. No external attachment means is required, such as shrinkwrapping, strings, chains, lanyards, etc. The user then purchases the combination and, when it is desired to use it, will extract fluid from the bottle 20 by removing the cap or operating the pump, as is well known in the art. It is also possible then to easily remove the brush 30 from the bottle and employ it in the well-known way in which brushes cooperate with cleaning fluids, such as soap. When the cleaning operation has been completed, the brush 30 can simply be snapped into place so that when the owner is next ready to perform a cleaning operation, the brush is readily available. Alternatively, the brush is provided with an apertured connector 34 on one of the legs 32 so that the brush could be hung up, although preferably the brush would be kept directly with the bottle.

While a full and complete description of the invention has been set forth in accordance with the dictates of the patent statutes, it should be understood that modifications can be resorted to without departing from the spirit hereof or the scope of the appended claims.

What is claimed is:

1. A brush and container combination, comprising:

a) a container body having opposed front and rear walls and opposed end walls interconnecting said front and rear walls to form an outer peripheral surface;

b) said container having a recessed area in said peripheral surface adjacent the juncture of said front and rear walls and one end wall;

c) said recessed area having opposed side walls extending inwardly from said peripheral surface of said container;

d) said recessed area having a transverse shoulder surface lying between the bottom of said recessed area and said peripheral surface of said container;

e) said recessed area having a pair of notches underlying said shoulder surface;

f) a brush releasably attachable to said container and having a main body portion and opposed legs depending therefrom;

g) said opposed legs terminating in opposed inwardly turned lips; and h) said lips engaging said notches when said brush is attached to said container.

2. The container combination of claim 1 wherein said shoulder surface of said recessed area is connected to said notches by opposed outer walls; and said opposed legs of said brush engage said outer walls when said brush is attached to said container.

3. The container combination of claim 1 or claim 2 wherein said brush is fabricated of resilient material.

4. The container combination of claim 1 wherein connector means are disposed on at least one of said depending legs of said brush.

5. The container combination of claim 1 wherein said main body portion of said brush has an outer surface; and said recessed area has a depth dimension relative to the length of said legs of said brush that said outer surface of said main body portion of said brush is disposed substantially flush with the peripheral surface of said container when said brush is attached thereto.

* * * * *